United States Patent [19]

Parise

[11] Patent Number: 4,974,701

[45] Date of Patent: Dec. 4, 1990

[54] STEP LADDER CONSTRUCTION

[76] Inventor: Ottavio Parise, 46 Tobermory Drive, Downsview, Ontario, Canada, M3N 2R7

[21] Appl. No.: 441,871

[22] Filed: Nov. 27, 1989

[51] Int. Cl.[5] ..... E06C 7/50; E06C 1/32

[52] U.S. Cl. ..... 182/194; 182/228; 182/23

[58] Field of Search ..... 182/228, 194, 220, 217, 182/23

[56] References Cited

U.S. PATENT DOCUMENTS

| | | | |
|---|---|---|---|
| 570,661 | 11/1896 | Cantrell | 182/23 |
| 665,238 | 1/1901 | Libby | 182/23 |
| 951,406 | 3/1910 | Mathes | 182/194 |
| 2,090,331 | 8/1937 | Kutscheid | 182/228 |
| 2,647,676 | 8/1953 | Napiecinski | 228/23 |
| 4,182,431 | 1/1980 | Wing | 182/23 |
| 4,204,587 | 5/1980 | Larson | 182/194 |
| 4,210,224 | 7/1980 | Kummerlin et al. | 182/207 |
| 4,655,320 | 4/1987 | Good | 182/194 |

*Primary Examiner*—Reinaldo P. Machado

*Attorney, Agent, or Firm*—Jeffers, Hoffman & Niewyk

[57] ABSTRACT

A step ladder construction is provided comprising a plurality of steps extending between a pair of struts. Coupling means join each of the steps with the pair of struts. Each of the struts has the shape of a channel with a pair of spaced webs between which the steps are received. The coupling means includes at least one flange element formed on one of the strut and the step, at least one surface defined on the other of the strut and the step to abut the flange element and fastening means to fasten the step to the strut with the flange element against the surface. The fastening means constitutes means to maintain the flange element against the surface while the flange element constitutes means to transfer a substantial portion of loads appearing on the step to the strut to reduce the shear loads appearing on the fastening means.

6 Claims, 4 Drawing Sheets

STEP LADDER CONSTRUCTION

The present invention relates to a ladder construction, and more particularly to a ladder construction for what is commonly referred to as a 'step ladder'.

Conventional step ladders are made from a pair of struts and a number of steps attached thereto. Each of the struts has a pair of webs which are spaced a distance equal to the width of the steps. The steps have a pair of side faces, each one of which is arranged to slide against the inside surface of a respective web. A rivet fastens each side face with its corresponding web to complete the structure.

In use, loads exerted on the step generate a shear force at each of the rivets. It can thus be seen that the load limit of the ladder so constructed is dictated by the combined shear strengths of the rivets joining the steps to the struts. As the ladder is used, it is subjected to repeated loads which place bending, shear and torsional loads on the various components of the ladder. These loads eventually cause the rivets joining the steps and struts to loosen, causing the ladder eventually to lose its structural integrity.

Attempts have been made to lengthen the operating life of these conventional step ladders by reinforcing the step and strut connections using braces which are riveted between the steps and the struts, usually at an angle to both. However, the use of braces complicates the assembly of the ladder thereby increasing its cost. Furthermore, there is still a reasonably high load exerted on the rivets joining the steps with the struts, resulting in the rivets loosening over a relatively short period of time. Accordingly, this type of construction, although it provides increased support for the struts, still suffers from disadvantages in that the lifetime of the ladder is limited due to loosening of the rivets.

As should be apparent, there remains a need for a practical and economical step ladder construction in which the tightness of the rivets is maintained for a longer period of time so that the operating life of the ladder is increased. It is, therefore, an object of the present invention to provide an improved step ladder construction which addresses this need.

Briefly stated, the invention involves a step ladder construction comprising:

a plurality of spaced steps extending between a pair of struts;

coupling means joining each of the steps with the pair of struts, each of the struts having the shape of a channel with a pair of spaced webs between which the steps are received; the coupling means including at least one flange element formed on one of the strut and the step, at least one surface defined on the other of the strut and the step to abut the flange element; and fastening means fastening each of the steps to the struts with the flange element against the surface, the fastening means constituting means to maintain the flange element against the surface whereby the flange element constitutes means to transfer a substantial portion of loads appearing on the step to the struts to reduce shear loads appearing on the fastening means.

In another aspect of the present invention, there is provided a step ladder construction comprising:

a pair of struts and a step; the step having a pair of ends to be attached respectively to the struts, a pair of side faces, an upper face and a lower face; each of the struts having a pair of web portions extending longitudinally therealong, the web portions being spaced from one another to receive one end of the step therebetween and to lie against the associated side faces; and fastening means to join each of the side faces with the associated web portion; the struts further including a pair of flange elements, each of which extends from a respective web portion, each of the flange elements having a surface to lie against the lower face; the flange elements constituting means to transfer substantially the entire load exerted on the step to the struts so as to reduce substantially shear loads exerted on the fastening means.

In this manner, the present invention provides a step ladder construction wherein a two stage interconnection significantly increases the operating life of the step ladder. The interconnection requires a flange element to be formed as an integral extension of the strut and a fastener to maintain the step on the flange element. The fastener inhibits relative play between the step and the flange element, while the flange element reduces the shear forces exerted on the fastener during use which would otherwise cause play.

The term 'step' ladder is a common term in the art which refers to a ladder having a pair of ladder sections hinged together by a plate which is fixed at one end to one of the ladder sections and pivoted at its other end to the other ladder section. In use, the ladder sections are disposed at an angle to one another and as such is free standing. This is in contrast to ladders such as the 'extension' ladder which has one or more nested ladder sections and which in use is leaned against a wall.

An exemplified embodiment of the present invention is illustrated in the accompanying drawings in which.

Figure 1:
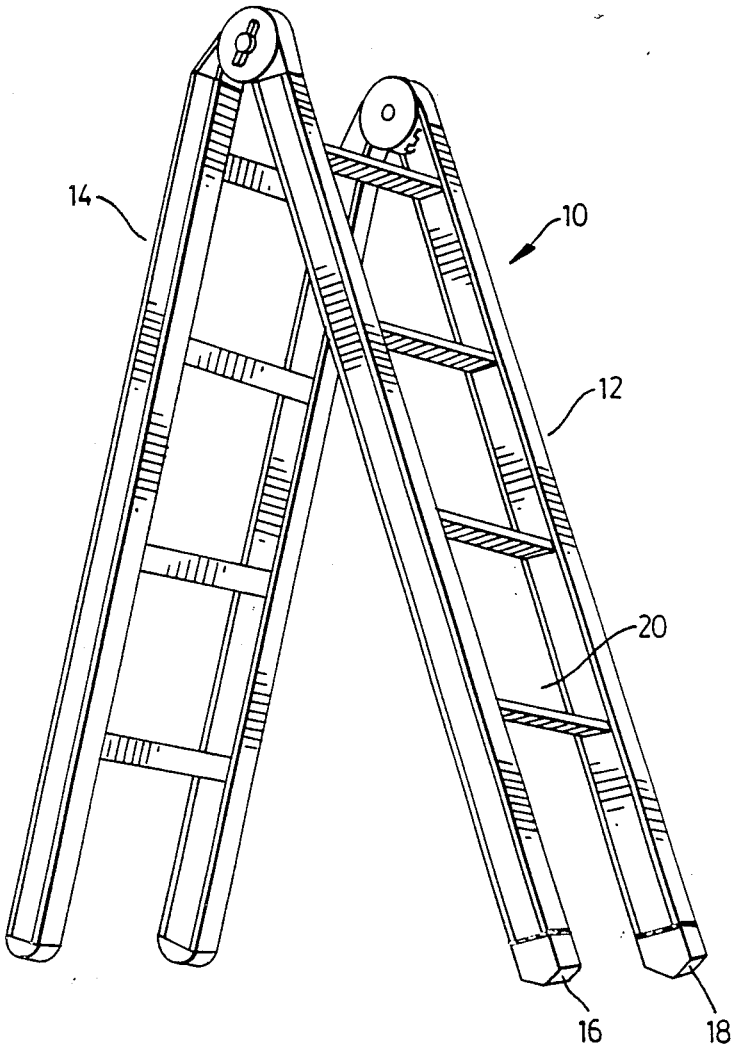
FIG. 1 is a perspective view of a step ladder.

Referring to FIG. 1, there is provided a step ladder generally indicated by reference numeral 10 having a pair of hinged sections 12, 14. Each section has a pair of spaced, channel shaped struts 16, 18 interconnected by a number of spaced, parallel steps 20.

A particular feature of the step ladder 10 lies in the coupling between the struts 16, 18 and the steps 20 to increase the operating life of the step ladder 10 beyond that of conventional ladder constructions.

Figure 2:
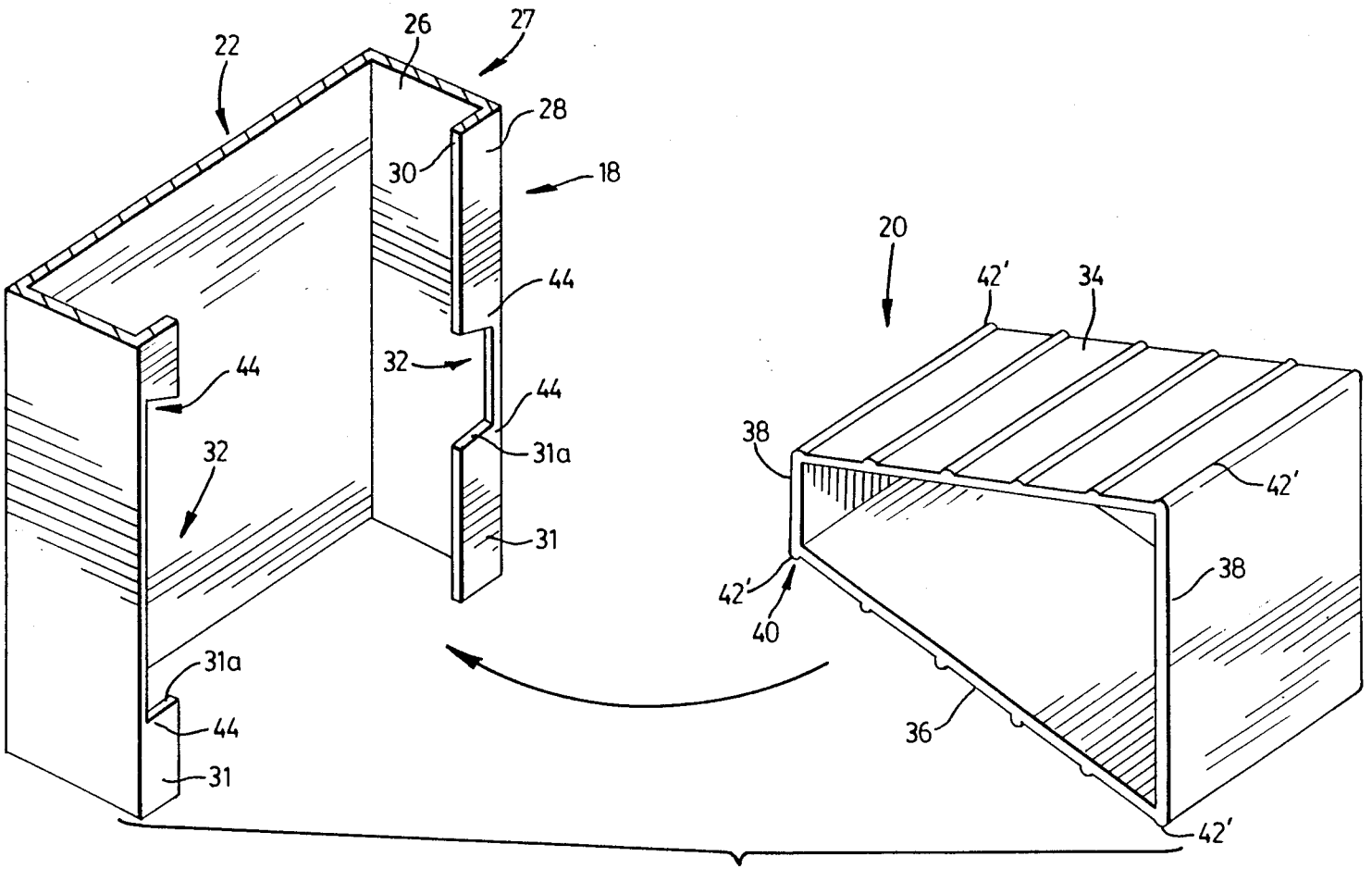
FIG. 2 is a fragmentary perspective assembly view of one portion of the step ladder illustrated in FIG. 1.
Figure 3:
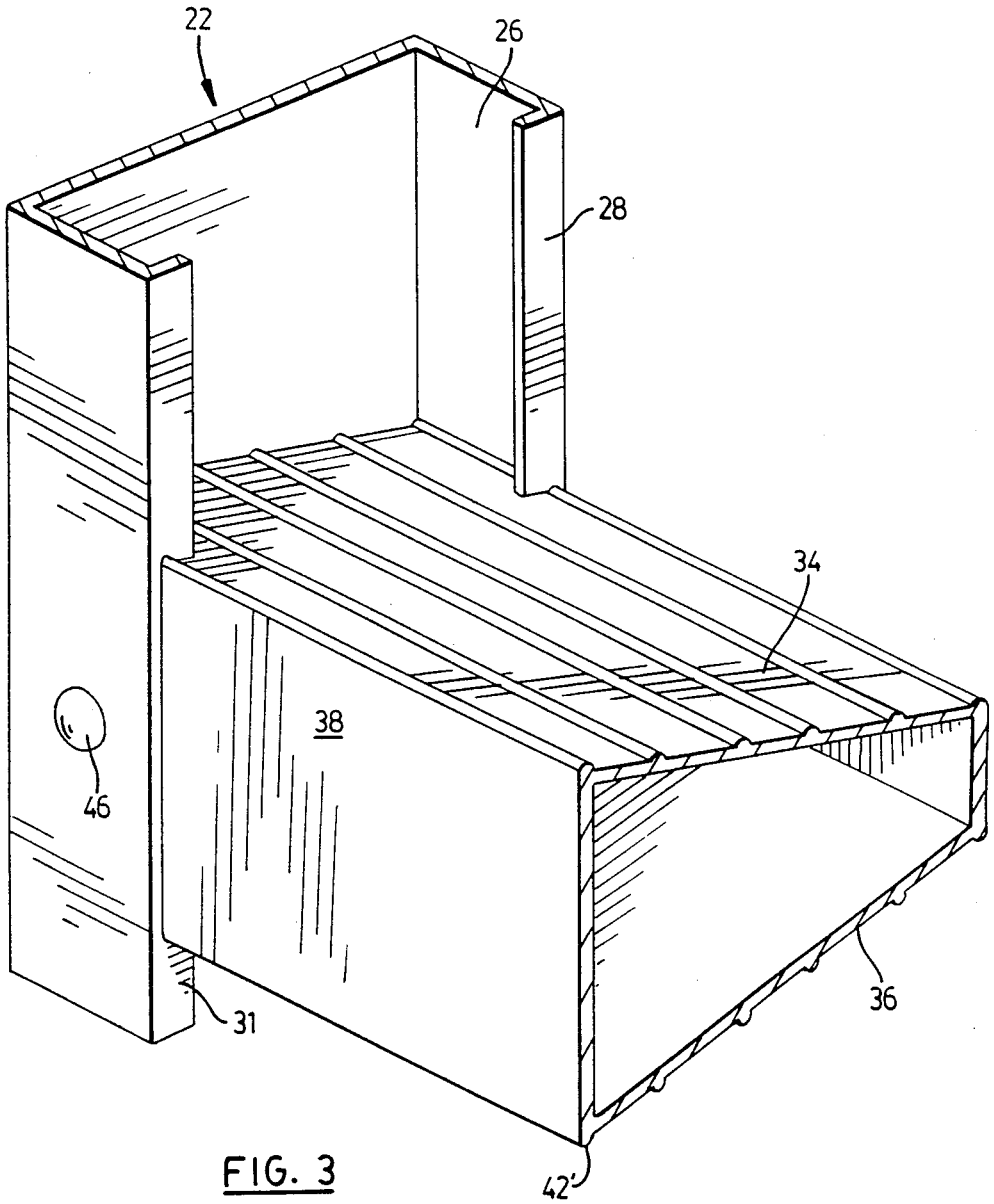
FIG. 3 is a view according to FIG. 2 with the components illustrated therein in an operative relationship.

Referring now to FIGS. 2 and 3, a portion of a strut 18 and a step 20 are better illustrated. Each of the struts 16, 18 has a back wall 22 and a pair of right angled channel sections 24 extending from one side of the back wall 22. Each of the channel sections 24 includes a web portion 26 generally perpendicular to the back wall 22 having an inner face. Each channel section 24 also includes a flange portion 28 which extends generally parallel to the back wall 22 and terminates at a free longitudinal edge 30.

Each of the flange portions 28 has a number of regularly spaced notches 32 along its length, which conform to the shape of a corresponding portion of the step. These notches form a plurality of flange elements 31.

Each of the steps 20 has an upper surface 34, a lower surface 36 and a pair of side faces 38 joined at corners 40. Each of the upper and lower surfaces 34, 36 has a series of spaced longitudinally oriented ridges 42, one of which is located at each corner 40 and is identified as 42'.

Each of the flange elements 31 has an upper surface 31*a* which abuts the lower surface 36 of the step 20. In addition, the notches 32 are shaped to provide each of the surfaces 31*a* with a circular indent 44 adjacent the adjoining web portion 26. The indent receives a corresponding ridge 42' formed on the step 20.

Conveniently, the back wall 22 and channel sections 24 may be formed from a single extrusion of aluminum. Alternatively, fiberglass or other structurally suitable materials may be used as desired.

To assemble each of the ladder sections 12,14, the struts 16, 18 are joined to the steps 20 by nesting the side faces 38 near each end of the steps within a corresponding notch 32. A hole is then formed through the web portion 26 and the side face 38 to receive a rivet 46.

When the steps 20 are nested within the notches 32, it will be seen that the ridges 42' fit within their associated indents 44. This provides an additional coupling between each flange element 31 and the step 20, which reinforces the step ladder 10 by reducing any tendency of the flange portions 28 to deflect under load. This in turn increases the torsional strength of the step ladder. It will, of course, be understood that the degree to which the ridge 42 and indent 44 will increase the coupling depends to a great extent on the tightness of fit between them.

The notches 32 formed in the flange portions 28 fit tightly against the associated faces 38 and ridges 42 of the steps 20. In forming this tight coupling, the loads exerted on the step, such as those which are generated by a user standing on the step, are transferred from the step 20 to the flange portions 28 and throughout the struts. With this arrangement, the shear limit of the rivets 46 does not influence the load limit of the step 20.

Figure 4:
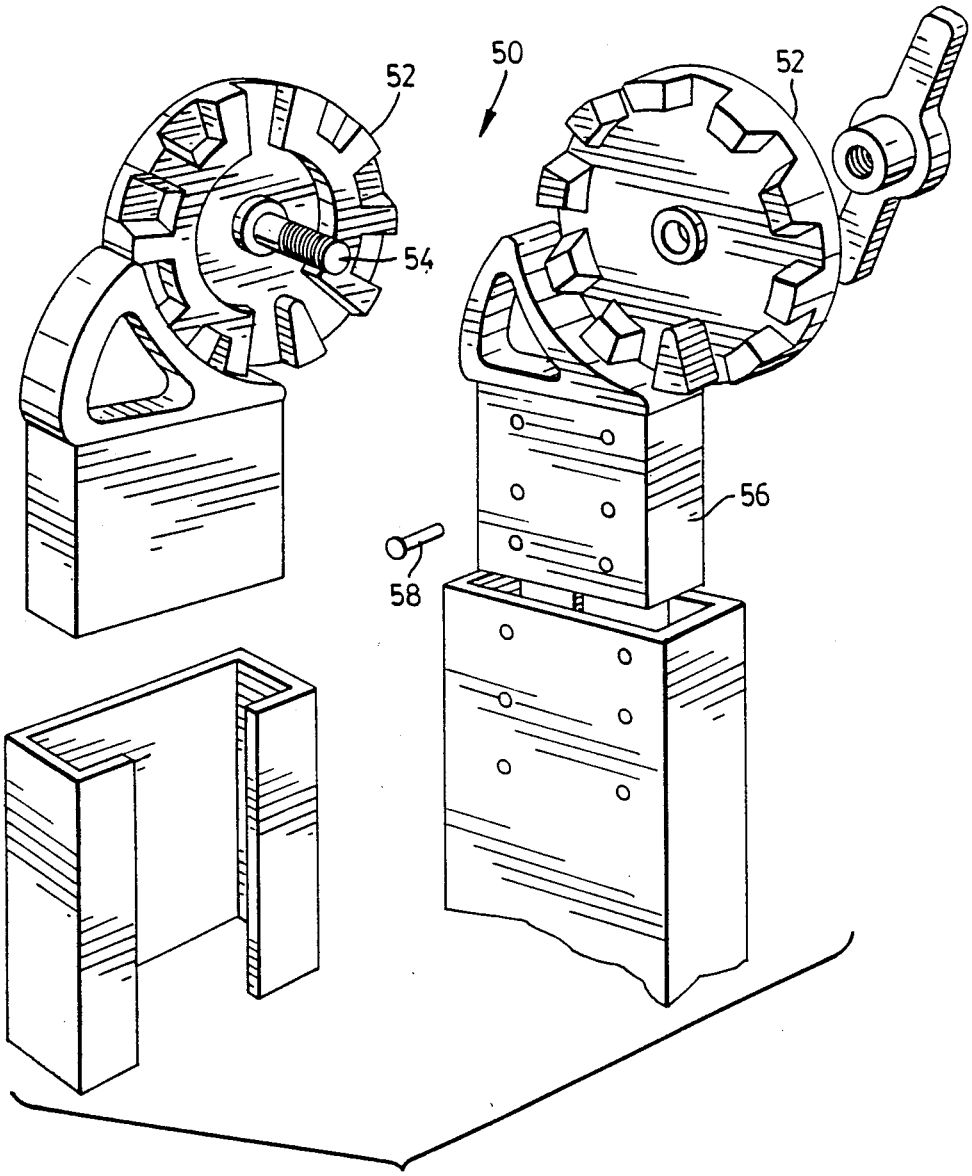
FIG. 4 is a fragmentary assembly view of another portion of the step ladder illustrated in FIG. 1.

Once the steps 20 and struts 16,18 are assembled together, the so formed ladder sections 12,14 are jointed by a pair of hinge elements as shown at 50 in FIG. 4.

Each hinge element 50 has a pair of elements 52 which are pivotally connected by means of a pin 54. Each strut is fastened to one of the elements 52 by means of a plug 56 which is inserted into the open end of the associated strut. The plug 56 and the strut are fastened together via rivets 58 or other convenient fasteners. In use, loads appearing at the hinge are transferred through the hinge elements 50 which, by virtue of their teeth are capable of withstanding a significantly higher force than hinges of conventional step ladders.

One particular feature of this ladder construction lies in the coupling of the strut and the step. When a user stands on the step, the flange elements 31 below the step 20 are subjected to a load. This load is directed through the struts via the flange elements rather than through the fasteners joining the step to the struts as in conventional ladder constructions. Thus, in the present design, the flange elements 31 significantly reduce the shear which would otherwise be exerted on the fasteners. As long as the shear exerted on the fasteners is maintained at this reduced level, the tightness of the fasteners are maintained.

Of course, wear will eventually appear between the lower surface of the steps and the upper surface of the flange elements. However, as long as the fasteners remain tight, the degree of wear appearing at these locations is minimal and will not materially affect the structural integrity of the ladder construction.

As a result, the tightness of the coupling depends on:

(i) a flange element formed as an integral extension of the strut to receive the step thereon; and (ii) a fastener joining the strut to the step to maintain the position of the step on the flange element.

It can be seen that the combination of the fastener joining the strut to the step and the flange element formed as an integral extension of the strut, create a pair of interconnecting elements, the strength of each of which depends on the integrity of the other.

The operating life of the step ladder 10 is even further enhanced by the manner in which the ladder sections 12 and 14 are hinged together. The hinge elements 52 transfer loads between the ladder sections in a manner which does not depend on the strength of rivets or similar fasteners used as the pivot point, as is the case in some conventional step ladder constructions, to join the ladder segments together.

The flange portion should have sufficient dimensions to withstand the loads exerted on the step ladder during use as well as the variety of loads which are exerted on it during transport and storage between jobs. The fastener need not be designed to withstand the degree of forces it would otherwise be subjected to in a conventional ladder construction. However, it should be selected so that it will withstand the variety of loads which are exerted on it during use, storage and transport. If so, the coupling formed by the fastener and the flange element will significantly increase the operating life of the ladder construction. Since the flange element is merely an integral extension of the strut, the costs associated with the addition of the flange element to the ladder construction are those incurred when the extrusion mold is formed and are economical when apportioned to the number of struts formed with the mold.

The integral nature of the strut and flange portion offered by the extrusion enables the step to be loaded with minimal shear loading appearing at the connection between the step and the strut. This is due to the fact that the load is transferred directly to the strut via the flange element rather than through the connection between the strut and the step. Therefore, the reduction of play between the strut and the step is provided by the reduction of shear loading on the connection therebetween.

If desired, the flange portion may be fabricated separately from the strut and fastened thereto with conventional fasteners, adhesives, or other techniques. In this case, the shear loading is diverted from the strut-step connection to the strut-flange portion connection. It follows then that the strut-flange portion connection must be sufficiently secure (that is, by providing a sufficiently large bonding surface) to enable the flange portion to support the step under load while maintaining the shear load appearing at the strut-flange portion connection below a level at which an undesirable degree of wear appears causing unwanted play.

In addition, the flange element may, if desired, be formed as an extension of the step rather than the strut, with the corresponding surface being provided on the strut by, for example, an aperture formed therein.

We claim:

1. A step ladder construction comprising:

a pair of struts and a step; said step having a pair of ends to be attached respectively to said struts, a pair of side faces, an upper face and a lower face; each of said struts having a pair of web portions extending longitudinally therealong, said web portions being spaced from one another to receive one end of said step therebetween and to lie against the associated side faces; and fastening means to join each of said side faces with the associated web portion; said struts further including a pair of flange elements, each of which extends from a respective web portion, each of said flange elements having a surface to lie against said lower face; said flange elements constituting means to transfer a substantial portion of loads exerted on said steps to said struts so as to reduce substantially shear loads exerted on said fastening means.

2. A step ladder construction as defined in claim 1 wherein each of said flange elements extends from one longitudinal edge of said strut.

3. A step ladder construction as defined in claim 1 wherein said flange elements and said web portions are integrally formed from a channel shaped element.

4. A step ladder as defined in claim 3 wherein each of said flange elements is formed from a flange portion extending along a remote edge of each of said web portions, said flange portion having a notch formed therein to form said surface.

5. A step ladder construction as defined in claim 1 wherein there is provided a plurality of steps and a plurality of flange elements on each of said web portions, said flange elements being formed by a flange portion extending along said web portion along one edge thereof with a plurality of notches formed therein, each of said notches being shaped to receive a portion of a given one of said steps.

6. A step ladder construction as defined in claim 5 wherein each step includes two ridges formed on said upper and lower surfaces, each ridge being located adjacent one of said side faces, each of said notches being shaped with a concave region to receive said ridge, said ridges constituting means to interconnect said step with said flange elements to increase the torsional strength of said step ladder construction.

* * * * *